United States Patent [19]

Moser

[11] Patent Number: 4,494,746

[45] Date of Patent: Jan. 22, 1985

[54] COPYING MACHINE WITH A CASSETTE GUIDE

[75] Inventor: Kürt Moser, Gerlingen, Fed. Rep. of Germany

[73] Assignee: Develop Dr. Eisbein GmbH & Co., Gerlingen, Fed. Rep. of Germany

[21] Appl. No.: 431,238

[22] Filed: Sep. 30, 1982

[30] Foreign Application Priority Data

Aug. 20, 1982 [DE] Fed. Rep. of Germany ... 8223544[U]

[51] Int. Cl.[3] ..... B65H 1/04

[52] U.S. Cl. ..... 271/164; 271/145

[58] Field of Search ..... 271/145, 162, 163, 164, 271/170, 171; 221/197, 198

[56] References Cited

U.S. PATENT DOCUMENTS 3,959,623 5/1976 Nakahara ..... 271/164

4,032,137 6/1977 Katayama et al. ..... 271/164

4,265,441 5/1981 Jonas ..... 271/164

*Primary Examiner*—Bruce H. Stoner, Jr.

*Assistant Examiner*—James E. Barlow

*Attorney, Agent, or Firm*—Barnes & Thornburg

[57] ABSTRACT

A copying machine and paper supply cassette is provided with a control arrangement to prevent operation of the machine upon improper insertion of the cassette. A control switch mechanism for controlling the electricity supply to the copying machine includes a pivotable control lever having a first arm engageable with catch part of the cassette so that said cassette pivots said control lever as it is inserted into a cassette guide of the machine. The control lever includes a second arm engageable through a second opening in the sidewall of the cassette to permit the pivoting movement of the control lever. The opposite side of the cassette includes no second opening so that insertion of the cassette in an upside down position is prevented.

14 Claims, 5 Drawing Figures

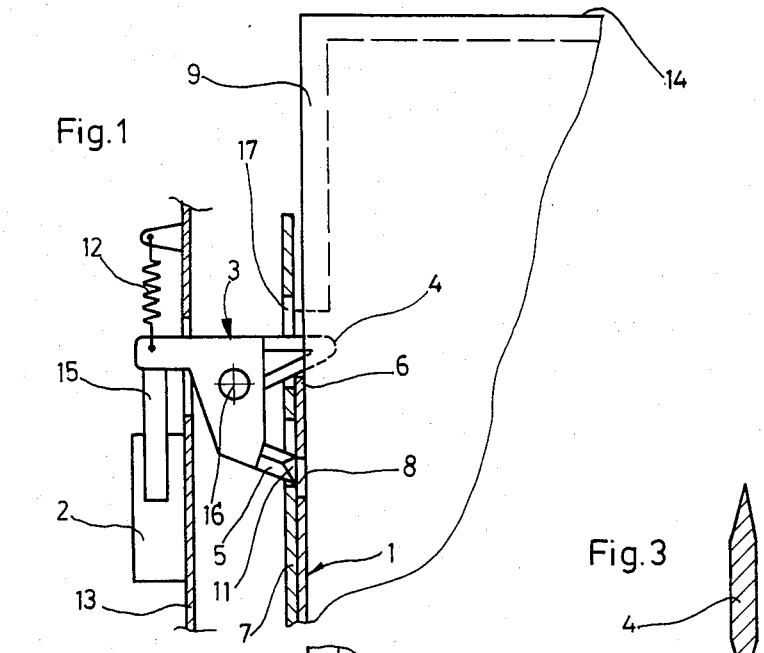
Fig.1
9
14
17
12
3
4
15
6
8
2
16
5
1
11
13
7
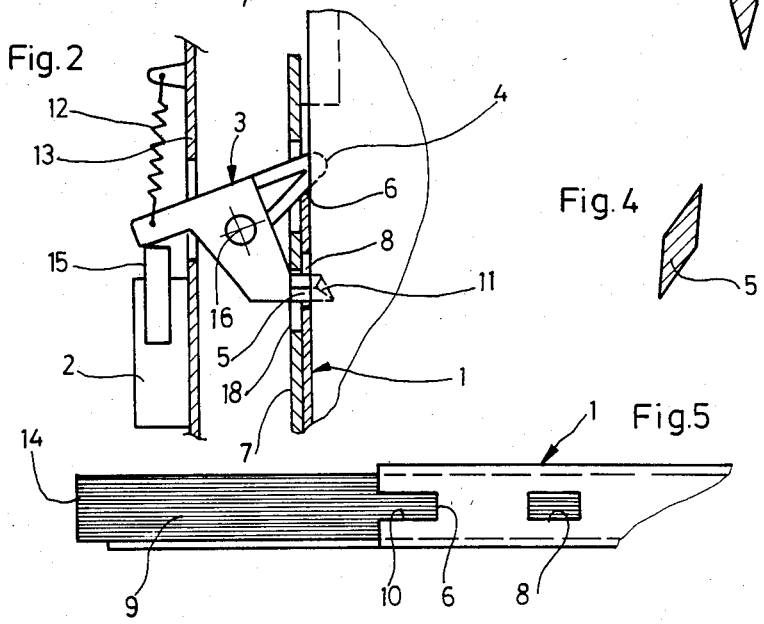
Fig.2
12
3
4
13
6
15
8
11
16
5
2
18
1
7
14
1
Fig.5
9
10
6
8
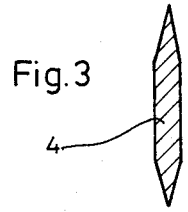
Fig.3
4
Fig.4
5

COPYING MACHINE WITH A CASSETTE GUIDE

BACKGROUND AND SUMMARY OF THE INVENTION

The invention relates to a copying apparatus with a guide for an insertable paper holding cassette, especially for a paper holding cassette for holding a stack of sheets of paper coated on one side thereof. In preferred arrangements, the cassette is formed as a flat rectangular holder bordering the stack of sheets of paper at the sides, bottom, top, and one end. At the other end of the cassette which is to be inserted into the copying machine, openings are provided in the sidewalls, in the top wall, and in the bottom wall so that the sheets of paper are freely accessible to be delivered into the machine.

Copying machines of the above mentioned kind are principally so called office copiers which are used by persons who are not especially skilled in the use and service of such machines. In practice it has been experienced that many difficulties arise because the cassettes are not correctly inserted into the copying machine. Although the cassettes are usually most clearly marked, it often happens that the cassettes are inserted with the sides reversed, which makes it impossible to make a copy with coated papers because the coated side is facing in the wrong direction. Frequently it also happens that the cassette is not brought correctly to its end in use position, which then can lead to the danger that the papers become jammed in the machine when copying is attempted.

The invention is based upon the proposition that a copying machine and the corresponding cassettes of the above mentioned type are so constructed that mistakes in the insertion of the cassette are avoided with certainty. The invention contemplates the provision of apparatus for detecting the correct insertion of the cassette, which apparatus includes a detection switch constructed in the form of a pivotal control lever with two arms extending parallel to the floor or bottom of the cassette. The first arm is engageable in a side edge of the cassette with a catch or receiver. The second arm is engageable into an opening in the cassette sidewall, spaced longitudinally from the catch, which opening accommodates pivoting movement of the lever by permitting the insertion of the second arm.

Through the arrangement of the invention it is obtained that the detection apparatus always indicates the conditions where no cassette is in the copying machine and when a cassette is incorrectly inserted or is not in its exact use position. As the cassette is inserted, the first arm of the control lever extends into the paper stack between two sheets without being activated by the sheets. The follower catch of the cassette sidewall effects a pivoting of the control lever. This pivoting movement is however only possible when the control lever is able with its second arm to extend inwardly into the opening of the cassette, so that there is a switching of the detection switch only if the cassette is correctly inserted with respect to its sides and is also moved into its exact in use position.

In order to simplify the penetration of the first arm of the control lever into the stack of paper and to avoid the danger of damage to individual sheets, especially preferred arrangements include construction of the arms of the control lever with tapered or beveled cut edges engageable with the stack of sheets. Because the second arm also extends sidewise into the stack of paper, it is advantageous if the end of the second arm engageable into the cassette is also sharpened.

In order to assure that the free forward edge of the stack of paper does not unintentionally activate the control lever and therewith the detection switch, preferred embodiments of the invention provide that the control lever is provided with a spring which is loaded to push the lever towards its base position. This spring is so configured that it has sufficient strength to prevent the pivoting of the lever only in reaction to the insertion of the lever arm into the paper stack.

In order to assure that only a small movement of the control lever does not lead to an activation of the detection switch, it is preferable that the detection switch is constructed as a spring loaded micro-switch. With this arrangement, only after a certain movement of the control lever is the switch operation activated. Furthermore the switching is independent of the speed or slowness of the insertion of the cassette into the copying apparatus.

These and further objects, features and advantages of the present invention will become more obvious from the following description when taken in connection with the accompanying drawings which show, for purposes of illustration only, a single embodiment in accordance with the present invention.

BRIEF DESCRIPTION OF THE DRAWINGS

FIG. 1 is a part sectional view through a copying machine showing a device for assuring the proper insertion of a cassette into its in use position, constructed according to a preferred embodiment of the invention;

FIG. 2 is a part sectional view, similar to FIG. 1, showing the position of the parts with a properly inserted cassette and the activated detection switch apparatus;

FIG. 3 is a cross-sectional enlarged view showing a first arm of the control lever of the FIG. 1 device;

FIG. 4 is a cross-sectional enlarged view through a second arm of the control lever; and FIG. 5 is a side view of the forward region of a cassette constructed according to the present invention for use with the detection device of the copying machine of FIGS. 1–4.

DETAILED DESCRIPTION OF THE DRAWINGS

In order not to obscure the present invention, only those parts of a copying machine are shown and described which are deemed necessary to an understanding and practice of the invention. This invention can be used, for example, with a copying machine of the kind disclosed in commonly assigned co-pending U.S. patent application Ser. No. 414,269, filed Sept. 2, 1982 now U.S. Pat. No. 4,443,092 issued Apr. 17, 1984, for the invention titled Compact Photocopying Machine, the contents of which are incorporated herein by reference thereto.

The copying apparatus illustrated in the relatively small part sectional views of FIGS. 1 and 2 exhibits two longitudinally extending parallel housing walls 13, of which only one (the left side as shown in FIGS. 1 and 2) is illustrated. The separate elements and aggregates of the copying machine are assembled at these housing walls such as shown in the above mentioned copending application. Between the two housing walls 13 there is a cassette guide 7, in a form of two facing open U-shaped profiles, which serve as a receiver for a cassette 1.

The cassette 1 (see also FIG. 5) is formed as a flat, rectangular holder in which a stack of sheets 9 of copying paper are arranged. The cassette 1, which is preferably formed of cut-out cardboard, surrounds the stack 9 almost completely. However, at the forward edge 14, insertable in the copying apparatus, the immediately adjacent parts of the bottom side, the upper side, and the two lateral sides are left free in order for the stack of sheets to be accessible to the copying machine apparatus for separating and drawing-off the individual sheets. It is important that the cassette 1, and therewith also the stack of sheets 9, is exactly disposed with respect to the following separating and drawing-off apparatus of the machine so that these can reliably function.

The cassette 1 is made out of a cardboard blank formed as specifically illustrated in FIG. 5, with the forward region 14 of the stack of sheets 9 freely accessable. In preferred embodiments, the cassette 1 is constructed with the provision of ripped or torn out lines at the forward part of the cassette for accommodating separation of same so that the forward sidewalls of the stack of paper can be removed just prior to insertion of the cassette in the machine so as to make the end of the stack of sheets freely available.

In order to assure that not only the exact insertion depth of the cassette, but rather also the proper side orientation is detected, a control apparatus is provided which detects simultaneously the exact position of cassette 1. The control apparatus includes a control switch 2, which is arranged in the electrical circuit supply of the copying machine and which switches the copying machine to its copying ready position when a cassette is inserted into its exact in-use position. The control switch 2, constructed as a microswitch with a snapping switch mechanism, is closed through the appropriate insertion of the cassette 1, whereby the copying machine is ready for copying operations.

The schematically depicted switch 2 is fastened to housing wall 13 and carries a movable switch part 15. The operation of the movable switch part 15 of the control switch 2 is effected by means of a control angle lever 3 which is pivotable about an axis 16 and which is arranged at the level of the sheets of the stack of sheets 9. The control lever 3 possesses a first arm 4 which is movable through an opening 17 in the guide 7 in the region of the cassette 1. This arm 4, which extends parallel to the floor or bottom of the cassette 1 and in the direction of the level of the stack of sheets in the sheet stack 9, is cut into a beveled shape (see FIG. 3) so that it can penetrate into the stack of paper 9 between two sheets when the cassette 1 is inserted with its stack of sheets 9. The lever is held in a base position by a guide spring 12 (FIG. 1), which is so arranged that the penetration of the arm 4 into the stack of sheets 9 does not provide sufficient force to pivot the lever arm 3. Only when a follower or catch edge 6, arranged at the rear of the free open region 10 of the sidewall of the cassette 1, engages against the arm 4, will the control lever 3 be pivoted by means of a further shoving-in of the cassette 1 against the force of the draw spring 12.

In order to also supervise or control that the cassette 1 is not sometimes inserted upside down with the sides reversed, the control device is so arranged that it also controls the correct disposition of the cassette 1 in this sense. For this purpose the control lever 3 is provided with a second arm 5, spaced at a distance from the arm 4, which arm 5 is disposed outside of the space of the guide 7 when in a base position (FIG. 1). If the lever arm 3 is pivoted through the engagement of the follower edge 6 of the cassette against the arm 4, the second arm 5 penetrates through an opening 18 of the guide 7 in the region of the cassette. The cassette is provided with an opening 8 in this region, which accommodates the penetration of the arm 5 through this opening 8 into the stack of paper 9. In order that the insertion of the second arm 5 does not damage the paper, the arm 5 is also arranged parallel to the level of the sheets of the stack of sheets and the floor of the cassette 1 and is sharpened (see FIG. 4). The end 11 of the arm 5 engagable into the cassette 1 is also pointed (FIGS. 1 and 2).

If the cassette 1 is inserted into the guide 7 with the sides switched, the control lever 3 cannot further be pivoted because there is an opening 8 in the cassette only on one side of the cassette 1 and arm 5 would be blocked from further movement by the side wall of the cassette. An upside-down insertion of the cassette is therefore prevented.

The cassette 1, which is manufactured out of cardboard blanks is further provided with a stamped out opening 10 at the side wall of the stack of sheets and facing the forward direction of the stack of sheets. The rear edge of the stamped-out part 10 forms the follower edge 6 by means of which the movement of control lever 3 is controlled. The opening 8 is also formed as a stamped out opening in the same sidewall of the cassette 1 as the opening 10. These stamped out parts permit an exact measurement so that a high degree of accuracy for the arrangement of the exact position of the cassette is assured.

The guide 7 of the copier apparatus shown in FIGS. 1 and 2 is constructed for a specific paper format. If a cassette 1 with paper of another format (different length and/or width) is to be used, the corresponding arrangement of the guide 7 is to be correspondingly modified to accommodate same. Embodiments are contemplated with the cassette 1 provided with orientation guiding means, for example in the form of ribs between the housing walls 13. These guiding means can then take over the guidance of the cassette 1 for narrower cassettes not guidable at the guide 7. Dependent on the width of the cassette 1, the arms 4 and 5 of the control lever 3 would be extended to reach into the corresponding openings of the narrower cassette. In this way the basic form and function of the switch mechanism need not be changed. The length of the arms 4 and especially the arm 5 need only simply be changed to accommodate the width of the cassette 1.

While we have shown and described a single embodiment in accordance with the present invention, it is understood that the same is not limited thereto but is susceptible to numerous changes and modifications as would be known to those skilled in the art of the present disclosure and we therefore do not wish to be limited to the details shown and described therein but intend to cover all such changes and modifications as are encompassed by the scope of the appended claims.

We claim:

1. An arrangement for supplying sheets of photocopying paper to a photocopying machine, comprising:

cassette means for holding a stack of sheets of photocopying paper including a first opening in a side wall at the forward end of the cassette means and a second opening in said side wall spaced from said first opening, cassette guide means for guidably holding the cassette means in an in-use position at a photocopying machine, and cassette position control means for assuring that the cassette means is in its proper in-use position including a pivotable control lever mounted on the photocopying machine adjacent the guide means and having first and second lever arms, wherein the rear edge wall of the first opening being engageable against said first lever arm to pivot said control lever toward a machine operating position as said cassette means is inserted, and wherein said second opening serves to accept insertion of said second lever arm therein to permit said control lever to be pivoted toward said machine operating position when said cassette means is properly inserted.

2. An arrangement according to claim 1, wherein the pivotable lever includes a part engageable with a photocopying machine switch so as to permit operation of the photocopying machine only with a properly inserted cassette means.

3. An arrangement according to claim 2, wherein the pivot axis for the control lever extends perpendicular to the plane of the sheets of paper in the cassette means when the cassette means is properly inserted.

4. An arrangement according to claim 1, wherein the lever arms each exhibit a flat shape which minimizes the disturbance of the stack of photocopying paper in the cassette means.

5. An arrangement according to claim 4, wherein the end of the second lever arm is sharpened to minimize the disturbance of the sheets of paper in the cassette means.

6. An arrangement according to claim 4, wherein spring means are provided for biasing the control lever toward a machine non-operating position.

7. An arrangement according to claim 2, wherein the photocopying machine switch is a spring biased microswitch activatable by the control lever.

8. An arrangement according to claim 7, wherein the microswitch operates to selectively interrupt or permit electrical power supply to said copying machine.

9. An arrangement according to claim 1, wherein said cassette means is constructed of hard paper or cardboard which surrounds the stack of sheets of paper therein on all sides over a substantial length of the sheets, leaving the forward end of the stack freely accessable to the sheet separating and supplying mechanisms of the photocopying machine.

10. A paper holding cassette for holding a stack of sheets of photocopying paper and insertable into a photocopying machine comprising:

a bottom wall engageable under the stack of sheets, a top wall, and side walls joining the top and bottom walls to together surround the stack of sheets along a substantial portion of the length of said stock, wherein the forward machine insertion of the end of the bottom, top, and side walls are configured to leave the forward end of the stack of sheets freely accessible to separating and drawing-off mechanisms of a photocopying machine, wherein one of the side walls includes a first opening exhibiting a catch part actuating a control lever and a second opening spaced from said first opening for accommodating movement therethrough of a second lever arm of said control lever, and wherein the opposite side wall of the cassette includes no second opening, whereby the second lever arm abuts said opposite side wall and prevents pivoting of the control lever when said cassette is inserted upside down.

11. A cassette according to claim 10, wherein the rear edge of the first opening serves as the catch part, the first opening being open in the forward direction.

12. A cassette according to claim 11, wherein the cassette is formed from cardboard blanks and where the first opening is stamped out of said side wall.

13. A cassette according to claim 12, wherein the second opening is stamped out of said side wall.

14. A cassette according to claim 12, wherein the opposite side wall of the cassette includes no second opening, whereby the second lever arm abuts said opposite side wall and prevents pivoting of the control lever when said cassette is inserted upside down.

* * * * *